US010801322B2

(12) United States Patent
Allgaier et al.

(10) Patent No.: US 10,801,322 B2
(45) Date of Patent: Oct. 13, 2020

(54) CUTTING DEVICE

(71) Applicants: Betek GmbH & Co. KG, Aichhalden (DE); Wirtgen GmbH, Windhagen (DE)

(72) Inventors: Thomas Allgaier, Schramberg (DE); Ulrich Krämer, Wolfach (DE); Heiko Friederichs, Aichhalden (DE); Thomas Lehnert, Oberraderb (DE); Karsten Buhr, Wilroth (DE); Cyrus Barimani, Königswinter (DE)

(73) Assignees: Betek GmbH & Co. KG (DE); Wirtgen GmbH (DE)

( * ) Notice: Subject to any disclaimer, the term of this patent is extended or adjusted under 35 U.S.C. 154(b) by 0 days.

(21) Appl. No.: 15/749,246

(22) PCT Filed: Jul. 11, 2016

(86) PCT No.: PCT/EP2016/066430

§ 371 (c)(1),
(2) Date: Jan. 31, 2018

(87) PCT Pub. No.: WO2017/021104

PCT Pub. Date: Feb. 9, 2017

(65) Prior Publication Data

US 2018/0223660 A1 Aug. 9, 2018

(30) Foreign Application Priority Data

Aug. 6, 2015 (DE) ..... 10 2015 112 988

(51) Int. Cl.
*E21C 35/183* (2006.01)
*E21C 35/193* (2006.01)

(52) U.S. Cl.
CPC ..... *E21C 35/183* (2013.01); *E21C 35/1933* (2013.01); *E21C 35/1831* (2020.05); *E21C 35/1833* (2020.05); *E21C 35/1837* (2020.05)

(58) Field of Classification Search
CPC ..... E21C 35/18; E21C 35/183; E21C 35/19; E21C 2035/1803; E21C 2035/1816
(Continued)

(56) References Cited

U.S. PATENT DOCUMENTS 4,684,176 A * 8/1987 Den Besten ..... E21C 35/197 299/107
4,711,503 A * 12/1987 Berchem ..... E02F 9/285 172/719

(Continued)

FOREIGN PATENT DOCUMENTS

CN 102421990 A 4/2012
CN 102864728 A 1/2013

(Continued)

OTHER PUBLICATIONS

International Search Report from corresponding PCT/EP2016/066430 (not prior art).

(Continued)

*Primary Examiner* — Sunil Singh
(74) *Attorney, Agent, or Firm* — Lucian Wayne Beavers; Patterson Intellectual Property Law, PC

(57) ABSTRACT

The invention relates to a cutting device for an earth working machine, having improved wear protection.

13 Claims, 4 Drawing Sheets

(58) Field of Classification Search
USPC ..... 299/100–113; 175/420.1, 420.2, 426, 175/430
See application file for complete search history.

(56) References Cited

U.S. PATENT DOCUMENTS

| | | | | |
|---|---|---|---|---|
| 6,270,165 | B1 | 8/2001 | Peay | |
| 7,600,823 | B2 | 10/2009 | Hall et al. | |
| 8,136,887 | B2 * | 3/2012 | Hall | E21C 35/183 299/105 |
| 8,540,037 | B2 * | 9/2013 | Hall | E21C 35/183 175/426 |
| 9,074,471 | B2 * | 7/2015 | Ojanen | B28D 1/186 |
| 9,562,431 | B2 | 2/2017 | Fries et al. | |
| 9,739,145 | B2 | 8/2017 | Lehnert et al. | |
| 2008/0035383 | A1 | 2/2008 | Hall et al. | |
| 2011/0089746 | A1 * | 4/2011 | Helsel | E21C 35/18 299/102 |
| 2011/0296720 | A1 | 12/2011 | Tack | |
| 2012/0056465 | A1 | 3/2012 | Gerer et al. | |
| 2013/0009446 | A1 * | 1/2013 | Hall | E21C 35/183 299/105 |
| 2013/0052481 | A1 * | 2/2013 | Konyashin | B22D 19/14 428/679 |
| 2013/0125872 | A1 * | 5/2013 | Konyashin | B22F 7/04 125/40 |
| 2014/0225418 | A1 * | 8/2014 | Lachmann | E21C 35/183 299/104 |
| 2015/0028654 | A1 | 1/2015 | Lehnert et al. | |
| 2018/0223660 | A1 | 8/2018 | Allgaier et al. | |

FOREIGN PATENT DOCUMENTS

| | | | | |
|---|---|---|---|---|
| CN | 104032663 | A | | 9/2014 |
| DE | 102011051520 | A1 | | 1/2013 |
| DE | 102012101719 | A1 | | 9/2013 |
| EP | 412287 | A2 | | 2/1991 |
| EP | 2053198 | A1 | * | 4/2009 |
| JP | 63104487 | A | | 5/1988 |
| JP | 11229777 | A | | 8/1999 |
| JP | 2003512551 | A | | 4/2003 |
| JP | 2012006021 | A | | 1/2012 |
| JP | 2013529250 | A | | 7/2013 |
| JP | 2014532821 | A | | 12/2014 |
| SU | 402656 | A | * | 3/1974 |
| WO | 2011128250 | A1 | | 10/2011 |
| WO | 2011128694 | A1 | | 10/2011 |
| WO | 2017021104 | A1 | | 2/2017 |

OTHER PUBLICATIONS

Japanese Office Action for corresponding Japanese application No. 2018-506190, 9 pages (not prior art).
Office Action dated Oct. 29, 2018 from corresponding China application (not prior art).
Australia office action in corresponding application No. 2016304316, dated Jan. 31, 2019, 3 pages (not prior art).

* cited by examiner

CUTTING DEVICE

The invention relates to a cutting device for an earth working machine, in particular a road milling machine, having a carrier on which a cutting insert is mounted, the carrier comprising a base part on which a holding extension having a receptacle is projectingly attached, the cutting insert being at least locally arranged in the receptacle and a mounting extension being arranged on a mounting side located oppositely from the holding extension.

The invention furthermore relates to a cutting device for an earth working machine, in particular a road milling machine, having a carrier on which a cutting insert is mounted, the carrier comprising a base part, a mounting extension being arranged on a mounting side of the base part.

DE 10 2011 051 520 B4 discloses a cutting device of this kind. As this document shows, the cutting device encompasses a base part and a carrier that can also be referred to in the context of the invention as a "bit holder." The base part can be mounted on a cutting drum of an earth working machine. The bit holder is inserted with its holding extension into an insertion receptacle of the base part, and can be immobilized there with a mounting screw. The bit holder itself possesses a bit receptacle in which a round-shank bit can be replaceably received. The round-shank bit usually comprises a bit head and a bit shank. The round-shank bit is inserted with the bit shank into the bit holder. The head carries a cutting tip that is made of metal carbide.

The cutting devices known from DE 10 2011 051 520 B4 are designed in optimized fashion with regard to wear, forming a wear system in which the round-shank bit forms the actual wear part. The bit holder survives a plurality of bit changes before reaching its wear limit. The expensive base part needs to be replaced relatively infrequently.

Efforts have recently been made to use bits whose cutting tip is made of a super-hard material. One of the following materials can be used, for example, as a super-hard material:

Diamond, monocrystalline diamond, polycrystalline diamond, sintered diamond, chemically deposited diamond, physically deposited diamond, natural diamond, infiltrated diamond, diamond layers, thermally stable diamond, silicon-bonded diamond, silicon carbide, cubic boron nitride, and compounds of the aforementioned substances.

A "super-hard material" is to be understood in the context of the invention in particular as a material having a hardness in the range between 80 and 130 GPa.

Cutting inserts of this kind are extremely wear-resistant and place entirely new demands on cutting systems. Cutting elements having super-hard material are known, for example, from U.S. Pat. No. 7,600,823 B2.

The object of the invention is therefore to furnish an effective cutting device for an earth working machine which is notable for improved wear resistance.

This object is achieved in that the cutting insert comprises a cutting tip having a super-hard material; and that the holding extension carries a hard-material element at least on its front region in the advance direction, in the zone between the cutting tip and the base part.

With the cutting tip made of super-hard material, it is possible to ensure an almost unchanged cutting engagement over a long period of time. In order to prevent excessive wear in that context, the holding extension is equipped, at least on its front region in the advance direction, with a hard-material element in the zone between the cutting tip and the base part. With the cutting tip made of super-hard material, it is possible to ensure an almost unchanged cutting engagement over a long period of time. According to the present invention, the hard-material element is arranged on the holding extension in order to prevent the holding extension from eroding, and the cutting tip from then breaking off because of the weakened cross-sectional geometry of the holding extension. The arrangement in this context is deliberately such that the hard-material element is arranged at the front in the advance direction. It has become apparent that during operational use, the removed soil material is directed, proceeding from the cutting tip, in a direction that is oriented oppositely from the advance direction and is slightly inclined toward the base part of the carrier. The hard-material element thus correspondingly protects this wear region. It has furthermore become apparent that, unexpectedly, a further volumetric flow of soil material is directed, proceeding from the cutting tip, past the front side of the holding extension to the carrying part. This secondary wear likewise results in considerable erosion processes at the front region of the holding extension, which according to the present invention are appreciably reduced with the hard-material element. It is consequently possible, thanks to the hard-material element according to the present invention, to decrease erosion of the holding extension and appreciably extend the service life of the carrier. In particular, it is also possible thereby to coordinate the service lives of the super-hard cutting tip and of the carrier with one another, so that with an optimum design they reach their wear limit approximately simultaneously.

Provision can be made according to the present invention that the cutting insert is held nonrotatably in the carrier. Vibrations during tool engagement, which could result in breakage of the super-hard material, can thereby be reduced.

In accordance with the invention, provision can also be made that the cutting insert comprises a head on which the cutting tip is mounted; and that the head is made at least locally of a material that has less wear resistance than the cutting tip but more than the material of the holding extension. It is thereby possible to coordinate the materials with one another in cost-optimized fashion, with the objective of achieving maximally uniform wear on the carrier. The result is to generate a cutting system in which, in the optimized state, the cutting tip and the carrier reach their wear limit simultaneously.

The head can preferably be made of metal carbide.

One conceivable variant of the invention is such that the cutting insert comprises a shank with which it is inserted into the receptacle of the holding extension. Preferably the cutting insert is pressed into the receptacle or received therein by inter-material bonding, for example soldered into the receptacle. Stable support of the cutting insert is achievable with the shank. It can furthermore be exactly aligned in the receptacle, so that reproducible manufacture becomes easily possible.

One conceivable inventive alternative is such that the cutting insert forms a concave transition in the transition region between the head and the shank; that the receptacle forms a convex transition in that region; and that a gap region filled with joining material, in particular solder material, is created in the region of those transitions. The result is to create a manufacturing-optimized design. In particular, deleterious stresses in the transition region between the head and shank can be reduced, so that breakage in that region during tool utilization is precluded. This design has furthermore proven to be advantageous because notch stresses during operational use are appreciably reduced. This has advantages in particular when shallow milling depths need to be worked, in which context appreciable transverse forces sometimes occur.

A particularly preferred variant of the invention is such that the head of the cutting insert widens proceeding from the cutting tip toward the holding extension.

The head thereby forms a diversion surface whose geometry can be configured so that the removed soil material flowing along the head can be directed away from the carrier material in order to decrease wear.

One possible inventive variant is such that the cutting tip comprises a carrier body that is joined, preferably soldered, to the head of the cutting insert; that one or more intermediate layers are applied onto the carrier body; that a top layer is applied onto the outermost side, facing away from the carrier body, of the intermediate layer; and that the material of the top layer is harder than the material of the intermediate layer.

With a layer structure of this kind it is possible to construct a stable cutting tip that, in particular, is extremely abrasion-resistant and also reliably withstands the shock stresses that occur.

One possible variant of the invention is such that the hard-material element is constituted by a hardfacing, for example a hardface weld, plasma hardfacing, or the like; and/or that the hard-material element is constituted by one or several hard-material segments that are joined to the holding extension.

The hard-material segments that can be used are, for example, metal carbide elements that are soldered to the holding extension.

In the context of the invention it is also possible to configure a cutting device in which the holding extension comprises, facing away from the base part, a supporting segment; the cutting insert at least locally covers the supporting segment with its head; and the hard-material element is guided under the head into the region of the supporting segment.

The transition region between the head and the holding extension is thereby effectively protected, by the hard-material element, from erosion. This prevents the supporting surface under the head from being eroded, which would result in rapid failure of the cutting insert.

A particularly preferred variant of the invention is such that the cutting insert comprises a deflector surface that is embodied in order to guide the soil material, removed by the cutting tip, at least locally past the base part of the carrier. The effect of wear on the carrier is thereby considerably reduced.

It is conceivable for the hard-material element to be arranged in arc-shaped fashion around the receptacle of the, for example cylindrical, holding extension, or to be applied onto the holding extension circularly around the receptacle.

Depending on the respective intended use, the hard-material element can be arranged over an arc in the range between 5 and 360 degrees.

Complete enclosure is also conceivable, in order to offer optimum protection.

Particularly advantageously, provision can be made that the arc-shaped hard-material element extends in front of the cutting insert, in a circumferential direction and in the advance direction, over a length that is greater than the diameter or the maximum cross-sectional dimension of the receptacle. The receiving region for the cutting insert is thereby simply and effectively protected from wear.

Provision can also be made in particular that the hard-material element has an extent, in the direction of the longitudinal center axis of the receptacle, which is greater than or equal to the height of the receptacle in that direction.

The object of the invention is also achieved with a cutting device for an earth working machine, in particular a road milling machine, having a carrier on which a cutting insert is mounted, the carrier comprising a base part, a mounting extension being arranged on a mounting side of the base part. According to the present invention, the cutting device is configured in such a way that the base part carries, on a working side facing away from the mounting side, a cutting element fixedly joined to the carrier, the cutting element carrying a cutting tip made of super-hard material, the cutting element carrying a mounting piece to which an extension is attached on the rear side oppositely to the advance direction; and that the mounting piece and the extension are supported with respect to the carrier by abutment surfaces.

The mounting piece, arranged at the front in the advance direction, reliably directs the removed soil material away from the cutting tip. The inventor has recognized that the highest wear pressure exists firstly in the region of the cutting tip. The super-hard cutting tip reliably absorbs this wear. Subsequently to the cutting tip, the soil material expands in the flow direction with the result that the wear pressure continuously decreases. This wear pressure, which is still high, is reliably absorbed on the mounting piece. Once the soil material has passed by the mounting piece, it attains an expansion state that can be reliably withstood by the carrier made, for example, of steel material. A highly effective wear system is thereby created. In order to achieve secure support of the cutting element, according to the present invention the latter comprises the rearward extension that is supported with respect to the carrier. Bending stresses can thereby be reliably dissipated. The rearward extension moreover also protects the rearward carrier region from erosion.

Particularly preferably, provision is made that the mounting piece and the extension are supported with respect to the carrier with interposition of an inter-materially bonded join, in particular solder material.

Dependable support of the join partners is achieved by way of the solder material. In particular, gap-free full-coverage support can be configured. Also preferably, the cutting element can be constituted from a hard material, for example metal carbide, that is sensitive to breakage stresses. If an inter-materially bonded support is then implemented, deleterious gap regions are then avoided in the supporting region in favor of secure, breakage-resistant support.

It is preferred according to the present invention for the mounting piece to be arranged in the advance direction in front of a holding extension of the carrier, and to cover it at least locally. With the holding extension, the cutting element can be held exposed above the base part of the carrier, and the mounting piece thus protects the holding extension. An aggressive cutting geometry can thereby be implemented.

One conceivable inventive alternative is such that the mounting piece comprises, on oppositely located sides, diverter surfaces inclined in the advance direction which are embodied to divert removed soil material toward the sides of the carrier.

Further wear optimization can be achieved by the fact that the cutting tip is preferably embodied asymmetrically and, for example, the cutting tip of the cutting element has a greater volume in its radially externally located region than in its radially inner region. An increased wear volume is thereby constituted in the region that is located radially externally and is most intensely exposed to wear attack.

Secure support of the cutting tip can be achieved by the fact that the cutting tip is supported on the head of the cutting element, oppositely to the advance direction, with a joining piece.

The invention will be explained in further detail below with reference to exemplifying embodiments illustrated by the drawings, in which:

FIG. 1 is a partly sectioned perspective side view of a carrier having a cutting insert;

FIG. 2 schematically depicts, in a side view and in section, a detail taken from FIG. 1;

Figure 1:
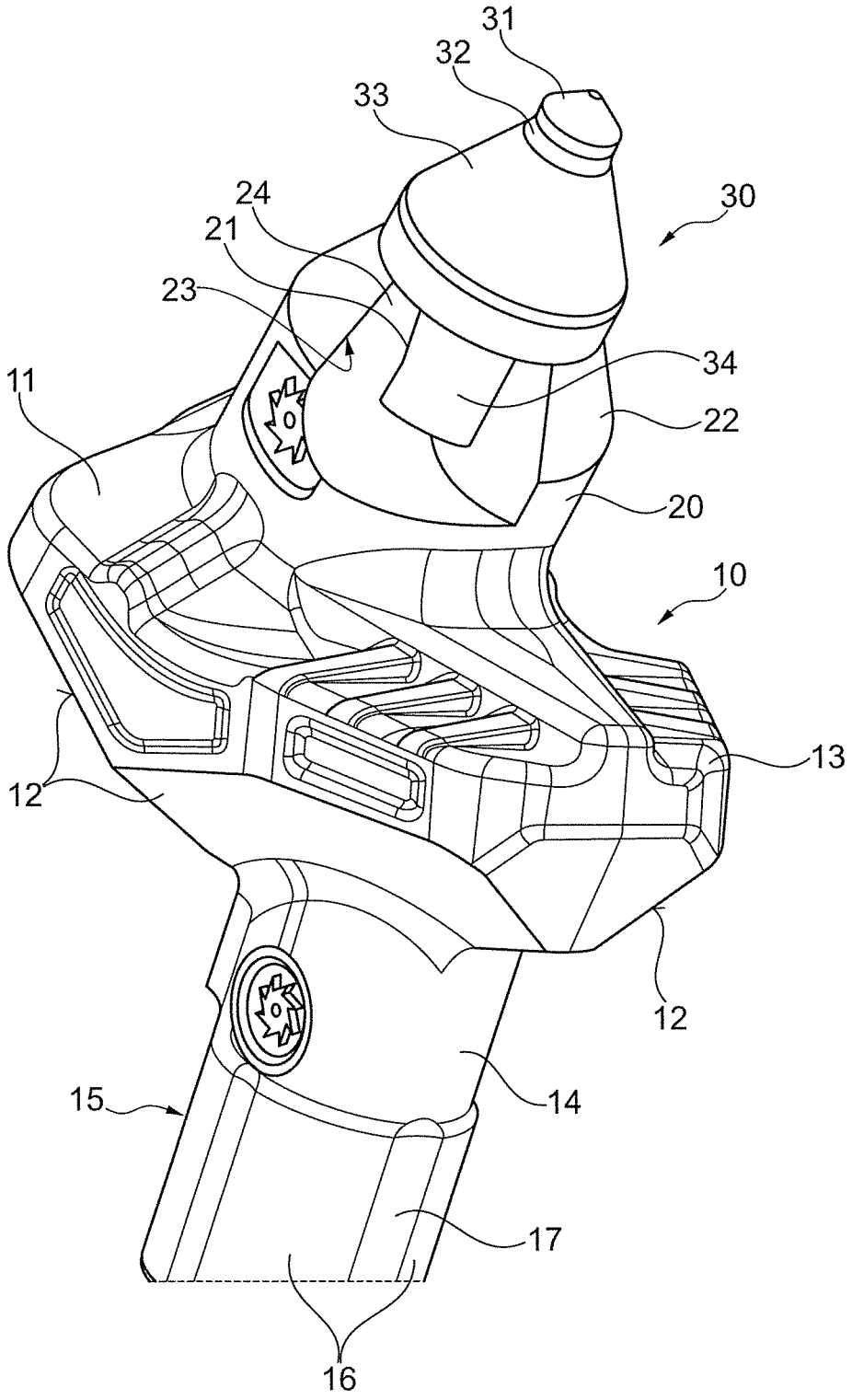

FIG. 1 shows a carrier 10 that is made of a steel material. Carrier 10 possesses a base part 11 having a mounting side and a working side. Four supporting surfaces 12 are arranged in the region of the mounting side. These supporting surfaces 12 are angled with respect to one another. Front and rear supporting surfaces 12 are provided. Front supporting surfaces 12 extend in the region of the underside of a skirt 13 of base part 11. Skirt 13 is arranged at the front in the advance direction. A mounting extension 14 is furthermore arranged in the region of the mounting side of carrier 10. In the context of the invention, mounting extension 14 can also be embodied as an insertion extension, as shown by way of example in FIG. 1. Mounting extension 14 can comprise a mounting receptacle 15 on the rear side oppositely to the advance direction. On the front side, mounting extension 14 possesses two supporting surfaces 16 arranged spaced apart from one another by way of a recess 17. Mounting receptacle 15 is embodied to receive the end of a compression screw. The compression screw introduces into mounting extension 14, via the mounting receptacle, a pulling-in force proceeding along the longitudinal extent of mounting extension 14. This force not only acts along the longitudinal axis of mounting extension 14, but also presses the two front supporting surfaces 16 onto corresponding counter-surfaces of a lower part of a quick-change bit holder.

Base part 11 carries a holding extension 20 in the region of the working side. As FIG. 1 shows, holding extension 20 projects beyond base part 11 with a preferably cylindrical extension. Holding extension 20 possesses a conical taper at the end. The free end of the conical taper is constituted by a supporting segment 24. Recessed into supporting segment 24 is a bore that constitutes a receptacle 21. As FIG. 1 shows, holding extension 20 is covered surroundingly, in the region of taper surface 23, by a hard-material element 22. This hard-material element 22 is embodied as a hardface weld. A cutting insert 30 is introduced into receptacle 21. Cutting insert 30 possesses a cutting tip 31 whose configuration will be explained in further detail later. Cutting tip 31 is joined via a joining piece 32, for example made of metal carbide, to a head 33 of cutting insert 30. A shank 34 is shaped onto head 33. Shank 34 is inserted into receptacle 21. The component comprising head 33 and shank 34 can be made, for example, of metal carbide. In particular, the hardness of this component is selected to be greater than the hardness of support 10 but less than the hardness of cutting tip 31.

Figure 2:
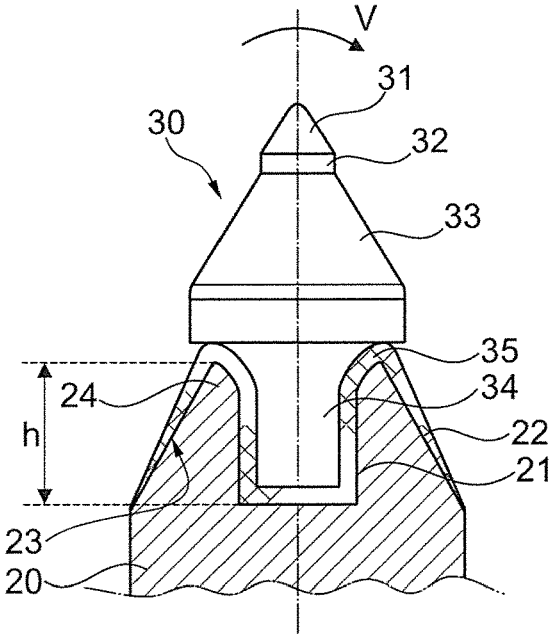

As is apparent from FIG. 2, shank 34 transitions via a concave transition into head 33. The oppositely located receiving region of receptacle 21 is correspondingly embodied concavely. As FIG. 2 shows, a gap region that is filled with solder material 35 is constituted between shank 34 and receptacle 21. Head 33 is thus in particular also supported on supporting segment 24 with interposition of solder material. This is advantageous because a risk of breakage is avoided thanks to this gap-free attachment. Stress peaks in the transition region between shank 34 and head 33 are reduced by way of the concave/convex surface pairing. Any other inter-materially bonded join can also be provided instead of solder material 35. It is furthermore conceivable for shank 34 to be shrink-fitted into receptacle 21. Also evident from FIG. 2 is hard-material element 22 that surrounds holding extension 20 in the region of taper surface 23. Hard-material element 22 is embodied and arranged in such a way that, with its height h, it completely covers the height of receptacle 21 in order to afford suitable protection from erosion. As FIG. 2 shows, it is also conceivable in the context of the invention for the hardface weld not to consistently have the same thickness. A varying thickness is instead conceivable in order to achieve appropriate wear behavior. For example, provision can be made that the thickness of hard-material element 22 decreases along the longitudinal center axis of the cutting insert.

Figure 3:
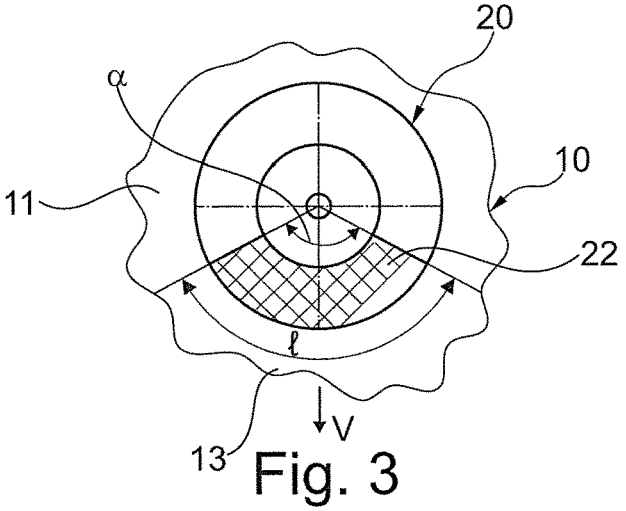
FIG. 3 shows what is depicted in FIG. 2, in plan view and as a first variant of the invention.
Figure 4:
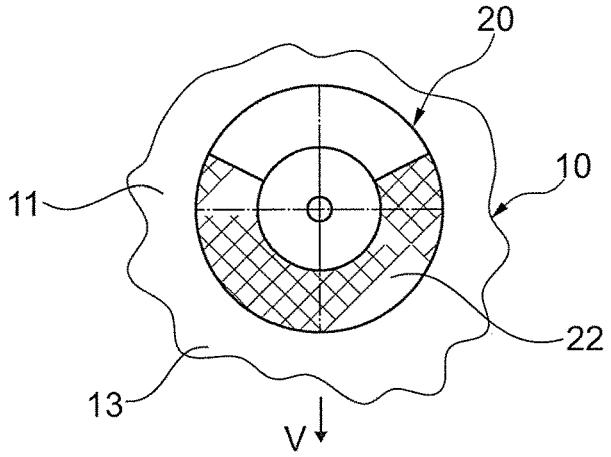
FIG. 4 shows what is depicted in FIG. 2, in plan view and as a second variant of the invention.

Hard-material element 22 can be applied surroundingly. It is also conceivable, however, for hard-material element 22 to be arranged on holding extension 20 over an arc sector, as is evident from FIGS. 3 and 4. As FIG. 3 shows, the arc length I in a circumferential direction of holding extension 20 should preferably be selected to be greater than the diameter of receptacle 21, or greater than the diameter of head 33. Hard-material element 22 also need not have a uniform thickness in a circumferential direction. Provision can instead also be made that the thickness varies in a circumferential direction, preferably decreases oppositely to the advance direction.

Figure 5:
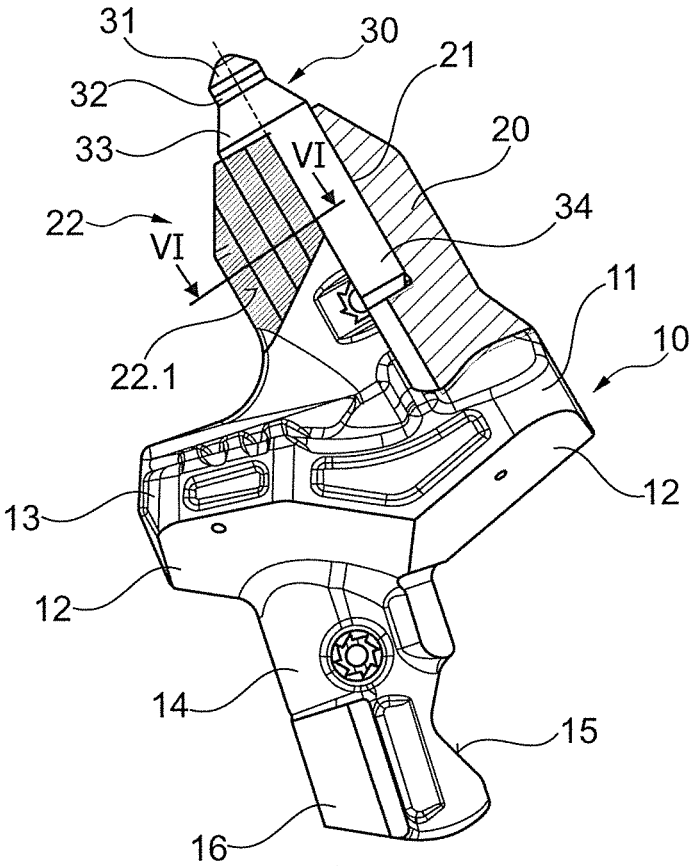
FIG. 5 is a partly sectioned side view of a carrier having a cutting insert, as a further embodiment of the invention.
Figure 6:
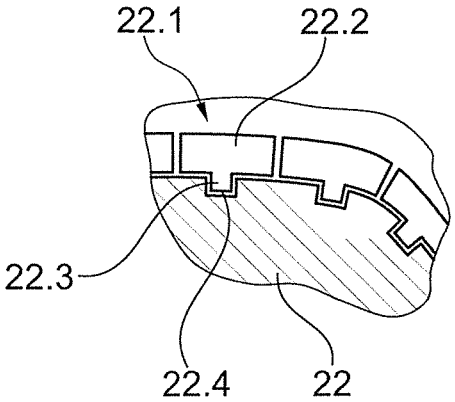
FIG. 6 shows a sectioned detail, taken from FIG. 5, along section line VI.
Figure 7:
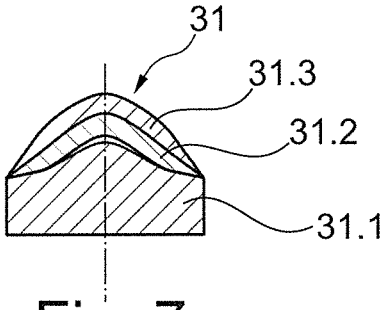
FIG. 7 is a schematic depiction, in vertical section, of a cutting tip of a cutting insert in accordance with the variants of the invention shown in FIG. 1 and FIGS. 6 to 8.

FIGS. 5 and 6 show a further exemplifying embodiment of the invention. As FIG. 5 shows, hard-material element 22 is constituted by hard-material segments that are mounted on holding extension 20. Hard-material elements 22 can be constituted, for example, by metal carbide elements that are applied by inter-material bonding onto holding extension 22. As FIG. 6 shows, hard-material elements 22 can be constituted by hard-material segments 22.1. For example, hard-material segments 22.1 can be plate-shaped. It is also conceivable, as shown in FIG. 6, for hard-material segments 22.1 to comprise a covering portion 22.2 onto which a mounting extension 22.3 is shaped. Hard-material segments 22.1 are introduced with mounting extension 22.3 into mounting receptacles 22.4 of holding extension 22. Hard-material segments 22.2 are joined by inter-material bonding, in particular soldered, to holding extension 20 in the region of mounting extension 22.3 and of the underside of covering portion 22.2. An example of the configuration of cutting tip 31 is evident from FIG. 7. A carrier body 31.1, for example made of metal carbide, is used, and an intermediate layer 31.2 is layered onto this. It is also conceivable for two or several intermediate layers 31.2 to be used. A top layer 31.3 is layered onto intermediate layer 31.2. Top layer 31.3 preferably possesses a concentration of polycrystalline diamond. Intermediate layer 31.2 likewise possesses a concentration of polycrystalline diamond. The concentration of polycrystalline diamond is higher in top layer 31.3 than in intermediate layer 31.2.

Figure 8:
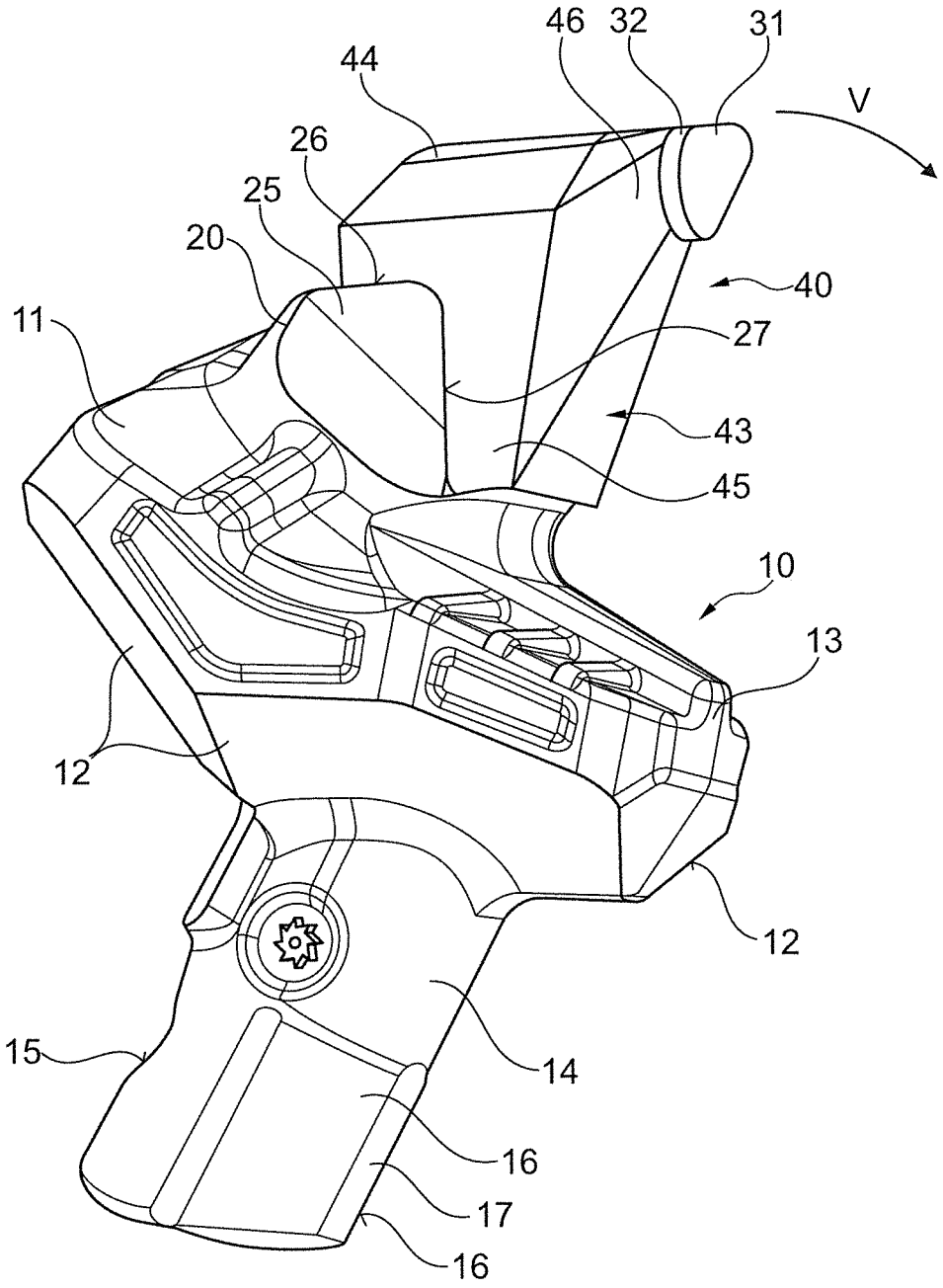
FIG. 8 is a perspective side view of a further variant embodiment of a carrier having a cutting element.

FIG. 8 shows a further variant embodiment of the invention. As is evident from this illustration, carrier 10 corresponds substantially to the configuration of carrier 10 according to FIG. 1, and therefore only the differences will be discussed hereinafter. In contrast to carrier 10 according to FIG. 1, carrier 10 according to FIG. 8 possesses a holding extension 25 that is shaped onto base part 11 facing away from mounting extension 14. Holding extension 25 comprises two abutment surfaces 26 and 27 angled with respect to one another. Abutment surface 27 is directed in advance direction V, and abutment surface 26 is directed oppositely to the advance direction. Cutting element 40 is placed onto the two abutment surfaces 26, 27 with interposition of an inter-materially bonded join, for example a solder join. Cutting element 40 possesses a head 43 that forms a mounting piece 45. Mounting piece 45 comprises two deflector surfaces 46 inclined in the advance direction. An extension 44 is shaped onto the rear side of mounting piece 43. Cutting element 40 abuts, with mounting piece 43 and extension 44, against abutment surfaces 26 and 27, as has been described above. Head 43 again carries a cutting tip 31 that is constructed in principle similarly to cutting tip 31 in accordance with the variant embodiments of FIGS. 1 to 7. Cutting tip 31 is, however, configured asymmetrically with respect to its longitudinal center axis and has a greater volume in its radially external region than in its radially internal region. This affords an increased wear volume in the region of the outer cutting edge of cutting tip 31. Cutting tip 31 is supported via joining piece 32, oppositely to the advance direction, on head 33 and is mounted there, preferably attached via an inter-materially bonded join, in particular a solder join.

The invention claimed is:

1. A cutting apparatus for an earth working machine, comprising:

a carrier including:

a base part;

a holding extension projecting from the base part, the holding extension having a receptacle defined therein, the holding extension including a supporting segment facing away from the base part; and a mounting extension arranged on a mounting side of the base part oppositely from the holding extension;

a cutting insert received at least in part in the receptacle of the holding extension, the cutting insert including a cutting tip made of a super-hard material, the cutting insert including a head at least partially covering the supporting segment; and a hard-material element formed on the holding extension in a zone of a front region relative to an advance direction of the cutting apparatus, the zone being located between the cutting tip and the base part, the zone extending so as to cover an arc-shaped area around the receptacle extending in front of the cutting insert and in a circumferential direction greater than 180 degrees and less than 360 degrees, the hard-material element extending under the head of the cutting insert throughout the zone of the front region.

2. The cutting apparatus of claim 1, wherein:

the cutting tip is mounted on the head; and the head is made at least partially of a material having less wear resistance than the cutting tip but more wear resistance than a material of the holding extension.

3. The cutting apparatus of claim 2, wherein:

the head is made at least partially of metal carbide.

4. The cutting apparatus of claim 1, wherein:

the cutting insert includes a shank, the shank being inserted into the receptacle of the holding extension.

5. The cutting apparatus of claim 4, wherein:

the cutting tip is mounted on the head;

the cutting insert includes a concave transition between the head and the shank;

the receptacle includes a convex transition; and a gap between the concave transition of the cutting insert and the convex transition of the receptacle is filled with joining material.

6. The cutting apparatus of claim 1, wherein:

the cutting tip is mounted on the head, and the head widens proceeding from the cutting tip toward the holding extension.

7. The cutting apparatus of claim 1, wherein:

the cutting tip includes a carrier body, the carrier body being joined to the head of the cutting insert, and the cutting tip further includes:

at least one intermediate layer received on the carrier body;

a top layer received on an outermost side of the at least one intermediate layer facing away from the carrier body; and wherein the top layer is made of a material harder than a material of the at least one intermediate layer.

8. The cutting apparatus of claim 1, wherein:

the hard-material element comprises a hardfacing on the holding extension.

9. The cutting apparatus of claim 1, wherein:

the hard-material element comprises at least one hard-material segment joined to the holding extension.

10. The cutting apparatus of claim 1, wherein:

the cutting insert includes a deflector surface configured to guide soil removed by the cutting tip past the base part of the carrier.

11. The cutting apparatus of claim 1, wherein:

the receptacle has a longitudinal center axis and has a receptacle height parallel to the longitudinal center axis; and the hard-material element extends parallel to the longitudinal center axis of the receptacle greater than or equal to the receptacle height.

12. The cutting apparatus of claim 1, wherein:

the hard-material element has a thickness which decreases in a direction toward the base part.

13. The cutting apparatus of claim 12, wherein:

the thickness of the hard-material element decreases from adjacent the supporting segment to an end of the hard-material element nearest the base part.

* * * * *